United States Patent [19]

Valentino

[11] Patent Number: 4,524,475

[45] Date of Patent: Jun. 25, 1985

[54] HOSPITAL BED STEP

[76] Inventor: Pearl T. Valentino, 5002 - 9 Ave., Rear Ground, Brooklyn, N.Y. 11220

[21] Appl. No.: 592,265

[22] Filed: Mar. 22, 1984

[51] Int. Cl.[3] ..... A47C 19/22

[52] U.S. Cl. ..... 5/507; 5/508; 182/91; 182/92; 248/295.1; 297/429; 403/108

[58] Field of Search ..... 5/507, 503, 508, 445, 5/444, 443; 297/438, 431, 433, 437, 429, 423; 248/231.7, 297, 295.1, 296; 182/90, 91, 92; 403/108

[56] References Cited

U.S. PATENT DOCUMENTS

| | | | |
|---|---|---|---|
| 2,605,155 | 7/1952 | Lewis | 5/507 |
| 2,709,818 | 6/1955 | Freese | 5/507 |
| 2,981,959 | 5/1961 | Burnham | 5/503 |
| 3,030,639 | 4/1962 | Boyer | 5/507 |
| 3,033,309 | 5/1962 | Fugere | 182/90 |
| 3,553,746 | 1/1971 | Seiger | 5/503 |
| 3,902,568 | 9/1975 | Erickson | 182/92 |
| 4,222,136 | 9/1980 | Valentino | 5/507 |

*Primary Examiner*—Alexander Grosz
*Assistant Examiner*—Vinh Luong
*Attorney, Agent, or Firm*—Richard L. Miller

[57] ABSTRACT

A hospital bed step which allows a patient to mount or dismount a hospital bed with ease and safety. The step clamps onto the upper bed rail with thumbscrews and rests upon the lower bed rail preventing downward and inward rotation. The step may be re-adjusted to any convenient height by removing a locking bar and reinserting the bar through aligned holes in a step clamp and in an adjustable step support rod. The step may be rotated under the bed for safe, convenient storage.

1 Claim, 5 Drawing Figures

HOSPITAL BED STEP

BACKGROUND OF THE INVENTION

Hospital patients often find it difficult accomplish the ascent or descent of a hospital bed. Hospital beds are frequently higher off the ground than comparable home beds. Ambulatory patients are often encouraged to walk around to rebuild muscles which may have fallen out of use due to long confinement in bed or to certain surgical procedures. It is, therefore, helpful to provide a hospital step which can be attached to the beds of ambulatory patients which will allow the patient to get on or off the bed with ease and safety.

A number of attempts have been made to design bed steps which meet this need, most notably P. T. Valentino, the instant inventor, in her invention: the training foot stool (U.S. Pat. No. 4,222,136). Although this invention meets part of the need for a bed step it has a number of deficiencies. Since it is designed for mounting on the bottom rail of a hospital bed, when a patient mounts the step the step tends to rotate down and away from the bed. Since all the stress is on the bottom rail, the bottom rail tends to deform. There is also no provision for locking the invention to a rail; the invention simply rests upon the bottom rail. There is also no provision for storing the invention without removing it entirely from the hospital bed.

SUMMARY OF THE INVENTION

It is therefore a primary object to provide a hospital bed step which attaches to the upper rail of a bed and uses the lower rail to steady the step, prevent any rotational motion and distribute the stress on the bed rail system.

A further object is to provide a hospital bed step which can be locked to the upper bed rail.

A still further object is to provide a hospital bed step which can be stored under the bed by rotating it one hundred and eighty degrees.

A yet further object is to provide a hospital bed step, which is sturdy and safe.

Another yet further object is to provide a hospital bed step which is easily adjustable in height.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 5:
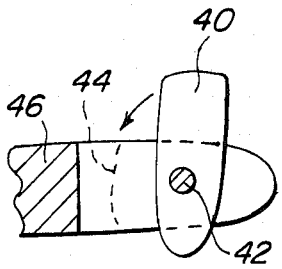
FIG. 5 is a cross sectional partial view taken on line 5—5 of FIG. 4.
Figure 1:
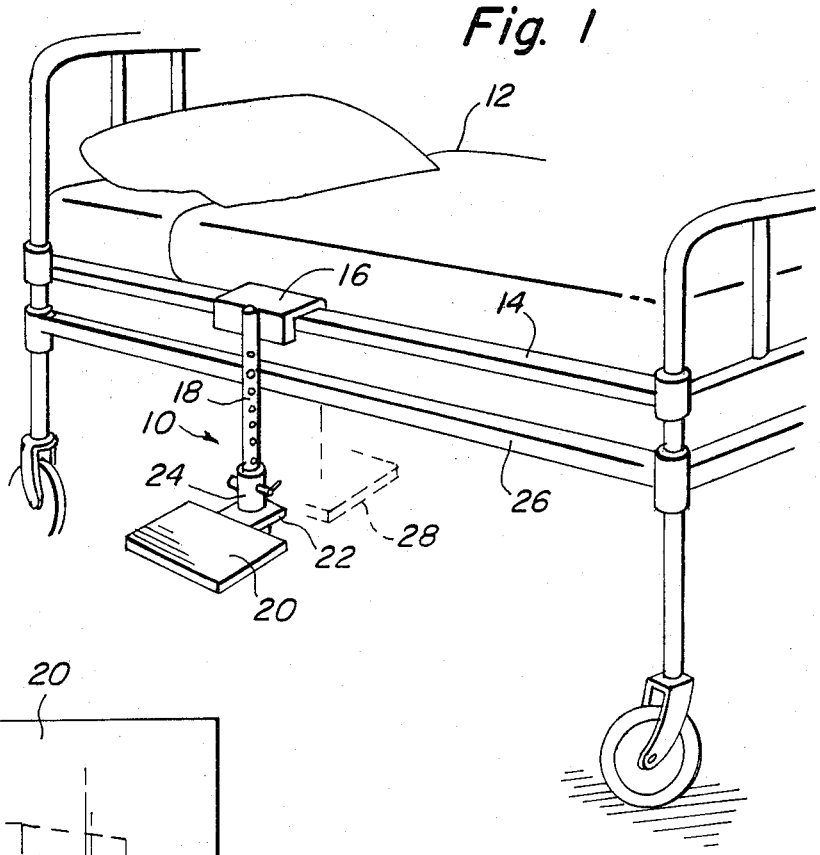
FIG. 1 is a perspective view of the invention shown in use installed upon a hospital bed.
Figure 2:
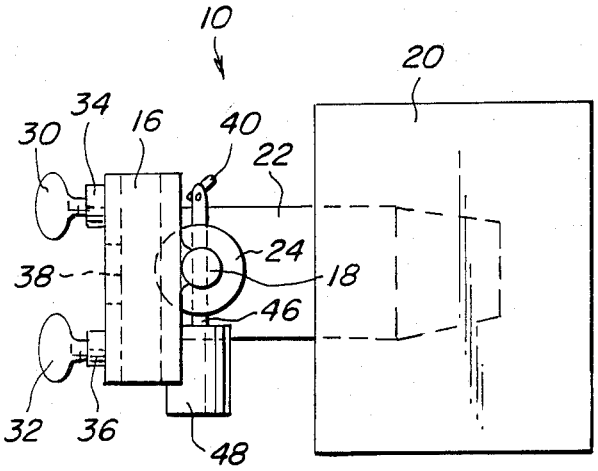
FIG. 2 is a top view of the invention.
Figure 3:
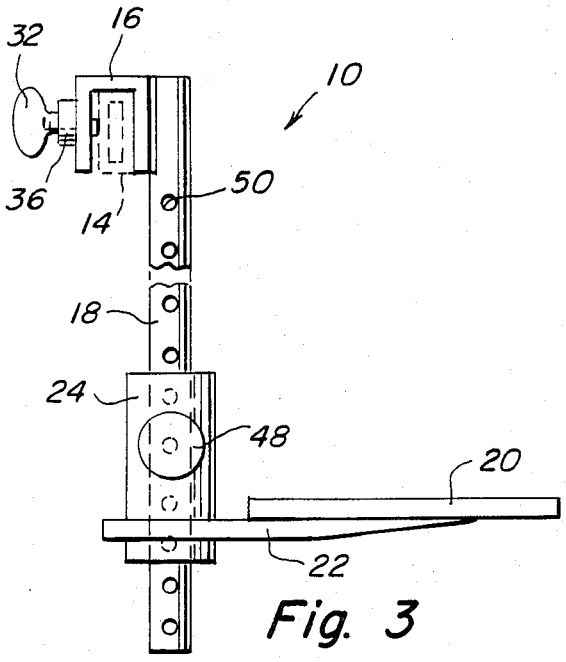
FIG. 3 is a side view of the invention.
Figure 4:
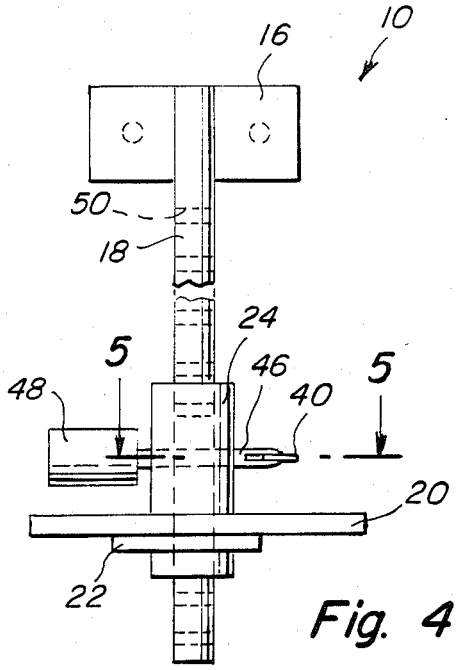
FIG. 4 is a front view of the invention.

In FIG. 1, the invention 10 is installed onto the top rail 14 of hospital bed 12. The principal components are a rail clamp 16 which clamps onto top rail 14, an adjustable step support rod 18 which is welded to rail clamp 16, and a step 20 and step support bracket 22 which is clamped to adjustable step support rod 18 by a step clamp 24. Adjustable step support rod 18 also rests against bottom rail 26 which prevents it from rotating downwards and inwards and helps distribute the rail system stress. The step 20, step support bracket 22 and the step clamp 24 may be rotated one hundred and eighty degrees placing step 20 into storage position 28 shown in phantom.

The clamping and height adjusting systems may best be understood with reference to FIGS. 2, 3, 4 and 5. Rail clamp 16 fits over top rail 14 and is held in place by thumb screws 30 and 32 which are threaded into associated threaded thumb screw bushings 34 and 36. An opening 38, between sections of rail clamp 16 is provided for bed springs which may coincide with the placement of the invention 10.

Height adjustment may be made by rotating latch 40 which rotates on pivot 42 to position 44 shown in phantom and removing locking bar 46 by pulling on end stop 48. Step 20, step support bracket 22 and step clamp 24 are then raised or lowered to the desired position and then locking bar 46 is reinserted through step clamp 24 and a pair of diametrically opposed holes in adjustable support rod 18 such as those typified by 50. Rotating latch 40 is then rotated to locking position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hospital bed step, comprising in combination:

(a) an adjustable step support rod which has a multiplicity of diametrically opposed holes placed at different heights along said support rod;

(b) a rail clamp which is attached to said adjustable step support rod, for securement to a top rail on a hospital bed which has three sides which are perpendicular to each other, wherein when said rail clamp is placed upon said top rail the top of said top rail and the front and back of said top rail are in direct contact with said rail clamp;

(c) means for locking said rail clamp to, said top rail on said hospital bed, which is a pair of threaded thumbscrews with mating thumbscrew bushings mounted to one side of said rail clamp wherein said thumbscrews force said top rail and said rail clamp together.

(d) a step upon which a patient may step in order to climb into said hospital bed;

(e) a step support bracket rigidly welded to said step;

(f) a step support clamp which is a length of tubing with at least one pair of diametrically opposed holes rigidly welded to said step support bracket;

(g) means for locking said step clamp with associated attached said step support bracket and said step, to said adjustable step support rod such that said step is rigidly fixed when a patient steps upon said step, which comprises a locking bar which passes through both said diametrically opposed holes in said step support clamp and through said diametrically opposed holes in said adjustable step support rod, an end stop on one end of said locking bar and a latch and pivot on the opposing end wherein once said locking bar has been inserted through said diametrically opposed holes, said latch which is shaped to pass through said holes may be rotated by ninety degrees thereby preventing the removal of said locking bar without first rotating said latch another ninety degrees; and (h) means for storing said step under said hospital bed without removing said rail clamp from said top rail of said hospital bed.

* * * * *